United States Patent [19]

Brandner et al.

[11] Patent Number: 4,627,401

[45] Date of Patent: Dec. 9, 1986

[54] HIGH-VELOCITY CARBURETOR FOR AN OTTO ENGINE

[75] Inventors: Burkhard Brandner, Werdohl; Helmut Schilly, Bergneustadt-Pernze; Albert Stübs, Lüdenscheid; Dieter Stojek, Bergisch-Gladbach, all of Fed. Rep. of Germany

[73] Assignees: Atlas Fahrzeugtechnik GmbH, Werdohl; Ford-Werke AG, Cologne, both of Fed. Rep. of Germany

[21] Appl. No.: 659,430

[22] Filed: Oct. 10, 1984

[30] Foreign Application Priority Data

Oct. 13, 1983 [DE] Fed. Rep. of Germany ..... 3337261

[51] Int. Cl.[4] ..... F02M 7/24

[52] U.S. Cl. ..... 123/439; 123/339; 261/DIG. 56; 261/DIG. 74; 261/44.4; 261/121.4

[58] Field of Search ..... 123/339, 439; 261/44 B, 261/44 C, 121 B, DIG. 56, DIG. 74; 251/129.09, 129.01

[56] References Cited

U.S. PATENT DOCUMENTS

| | | | |
|---|---|---|---|
| 2,911,183 | 11/1959 | Matthews et al. | 251/129.09 X |
| 3,383,084 | 5/1968 | Mayfield | 251/129.1 X |
| 3,925,521 | 12/1975 | Otani | 261/44 C X |
| 3,963,009 | 6/1976 | Mennesson | 261/44 C X |
| 4,118,445 | 10/1978 | Shishido et al. | 261/44 B |
| 4,517,134 | 5/1985 | Nakamura et al. | 261/44 C X |

FOREIGN PATENT DOCUMENTS

| | | |
|---|---|---|
| 3100457 | 11/1981 | Fed. Rep. of Germany . |
| 3143395 | 6/1982 | Fed. Rep. of Germany . |
| 3234121 | 7/1983 | Fed. Rep. of Germany . |

*Primary Examiner*—Willis R. Wolfe, Jr.

*Attorney, Agent, or Firm*—Schwartz, Jeffery, Schwaab, Mack, Blumenthal & Evans

[57] ABSTRACT

A high-velocity carburetor for an Otto engine comprising a slide for changing the cross-section of the suction pipe, a nozzle connection receiving nozzles and a profiled nozzle needle seated on the slide and controlling the cross-section of the nozzle. One object is the precise adjustment of the air admixture and thus an optimum mixture regulation as a function of the most important parameters for the operational conditions. The nozzle connection contains two nozzles, situated coaxially to one another and separated from one another by an intermediate chamber. The intermediate chamber is connected to an outlet channel of a flow control value having a ferromagnetic membrane-like valve plate. The valve plate is operable by two coils opposing each other and being connected to push-pull outputs of a pulse generator with adjustable pulse duty factor. An input channel of the flow control valve is connected with the atmospheric air via an air filter. For the control of the pulse duty factor an address memory is provided which can be addressed by load values, speed values, and temperature values and which contains in the form of a performance characteristic field information values for the pulse duty factor so that the pulse duty factor and thus the air admixture in the intermediate chamber can be adjusted in accordance with said information values.

8 Claims, 3 Drawing Figures

HIGH-VELOCITY CARBURETOR FOR AN OTTO ENGINE

BACKGROUND OF THE INVENTION

1. Field of the Invention

The invention relates to a high-velocity carburetor for an Otto engine comprising a slide for changing the cross-section of the suction pipe, a nozzle connection receiving nozzles and a profiled nozzle needle seated on the slide and controlling the cross-section of the nozzle.

2. Description of the Prior Art

Such a high-velocity carburetor with slide does not possess a throttle valve so that in contrast to a variable venturi carburetor practically the full suction pipe pressure is present on the nozzle in the region of the slide. Consequently, particularly in the partial load region, very high flow rates are effective at the nozzle and thus excellent spraying properties are present.

According to the size of the annular gap between nozzle and needle in the intermediate chamber between the two nozzles a vacuum is built up in proportion to the suction pipe vacuum. The cross-section relation of the nozzles and/or the ascending profile of the nozzle needle determine the amount of the negative pressure existing between the nozzles in the intermediate chamber. It is possible by the profiling of the nozzle needle to assign a fuel quantity to a specific slide position, i.e. to a determined vacuum. However this fuel amount is not always in the optimum operating range of the engine. If one selects for a specific nozzle needle profile characteristic the fuel apportioning in such a manner that an enriched mixture condition results, then it is possible to reduce by air admixture in the intermediate chamber the vacuum existing therein. Thereby the fuel amount can be reduced and the fuel-air mixture is weakened. The air admixture in addition to the regulation of the fuel-air mixture, also effects a further improvement of the atomization.

SUMMARY OF THE INVENTION

An object of the present invention is a precise adjustment of the air admixture and thus an optimum mixture regulation as a function of the most important parameters for the operating condition.

According to the invention of this object is solved in that the nozzle connection contains two nozzles situated coaxially to one another and separated from one another by an intermediate chamber, that the intermediate chamber is connected to the outlet channel of a flow control valve having a ferromagnetic membrane-like valve plate, that the valve plate is operable by two coils opposing each other and being connected to push-pull outputs of a pulse generator with adjustable pulse duty factor, that an input channel of the flow control valve is connected with the atmospheric air via an air filter, and that for the control of the pulse duty factor an address memory is provided which can be addressed by load values, speed values, and temperature values and which contains in the form of a perfomance characteristic field information values for the pulse duty factor so that the pulse duty factor and thus the air admixture in the intermediate chamber can be adjusted in accordance with said information values.

From the DE-OS 31 43 395 a balanced carburetor with slide is known, wherein, in the nozzle inner face, ports of a secondary air channel are provided, the opening of which is controlled by the movement of the nozzle needle. Thereby the secondary air amount has to be adjusted and the fuel-air mixture has to be stabilized. Consequently the secondary air is controlled according to the position of the slide. As a function of the temperature of the engine, the secondary air channel can be influenced. However, these measures cannot be applied in the case of a high-velocity carburetor because of their constructional configuration.

The high-velocity carburetor according to the invention differs from the prior art in a non-obvious manner in that the admixing of air is carried out via a flow control valve, the flow of which can be predetermined by the kind of the valve control precisely. The valve plate is designed like a membrane and therefore almost without inertia so that the same can follow each acceleration without delay. The valve control by means of a pulse-like operation of the valve plate avoids intermediate positions of the valve plate. The valve plate is substantially always completely in the open position or in the closed position, respectively. The duration and the period of the individual movements are determined by the pulse duty factor of the existing pulses for the coils. The pulses may have frequencies up to 1 kHz. The pulse duty factor is adjustable continuously between 0% and 100%.

The correlation of the valve opening duration determined by the pulse duty factor and thus the amount of the air admixture for the individual operating values of the engine is effected in such a manner that the performance characteristic field is arranged in speed characteristic lines according to load and temperature parameters and also contains particular acceleration characteristic lines. The information values for the amount of the air admixture are selectable according to the substantial operating parameters of the engine irrespectively of the suction pipe vaccum. One may predetermine for the starting condition in the case of a cold engine a particular speed characteristic line with high air admixture. Therefore, a starting automatism is not necessary. The same is valid for acceleration phases which are recognized for example by a discontinuous change of the position of the gas pedal. Then a smaller amount of additional air is admixed so that the fuel-air mixture is enriched or fatted and higher accelerations are possible. Consequently, an acceleration pump is not necessary.

On the other hand, the nozzle needle secures the emergency running properties of the engine, if the flow control valve fails. Altogether, the present invention gives a high-velocity carburetor the properties of a central injection.

In order to be able to adjust also the idling speed of the Otto engine with a high-velocity carburetor, the invention provides that for the adjustment of the idling speed a pneumatical positioning element with a positioning piston is provided, the piston rod of which serves as positioning element for the slide, that the positioning chamber of the positioning element is connectable with the suction pipe of the high-velocity carburetor, that for the control of the positioning chamber a further flow control valve controlled by a pulse generator is provided, which controls a flow path from the positioning chamber to the atmosphere, and that in the case the idling speed falls below a nominal speed value the pulse duty factor of the pulse generator is controlled in the sense that the suction pipe pressure is effective in the positioning chamber.

It is effected by this arrangement that the idling speed can be kept constant also in the case of load changes. It is important that one obtains by the air admixture in the intermediate chamber a weakened mixture during idling so that the pollution is low when running idle.

In order that the vacuum in the suction pipe can be effective within the pneumatic cylinder as quick as possible, the invention provides that the flow control valve has a greater flow than the restrictor in the connection with the suction pipe. In addition to the adjustment of idling described above, the combination of idling adjustment and mixture control valve replaces the temperature or time controlled starting automatisms known up to now. Via the mixture control valve the enriched or fat fuel-air mixture required for the cold start can be adjusted. By the temperature-dependent allowance of a running up speed raised in regard to the nominal or hot idling speed the required higher air amount during cold starting and running up is supplied to the engine via a slide opening increased accordingly.

In order that the adjustment of the idling influences the vacuum in the suction pipe as low as possible and that the resetting of the positioning element is effected in a retarded manner, the invention provides that the connection to the atmosphere contains a restrictor the flow cross-section of which is smaller than the flow cross-section of the restrictor to the suction pipe. The flow cross-section of said restrictors determines the time variations of the positioning movement.

BRIEF DESCRIPTION OF THE DRAWINGS

Embodiments of the invention will be described in the following with reference to the accompanying drawing, wherein FIG. 1 schematically shows the high-velocity carburetor.

DESCRIPTION OF THE PREFERRED EMBODIMENT

Figures 1, 2:
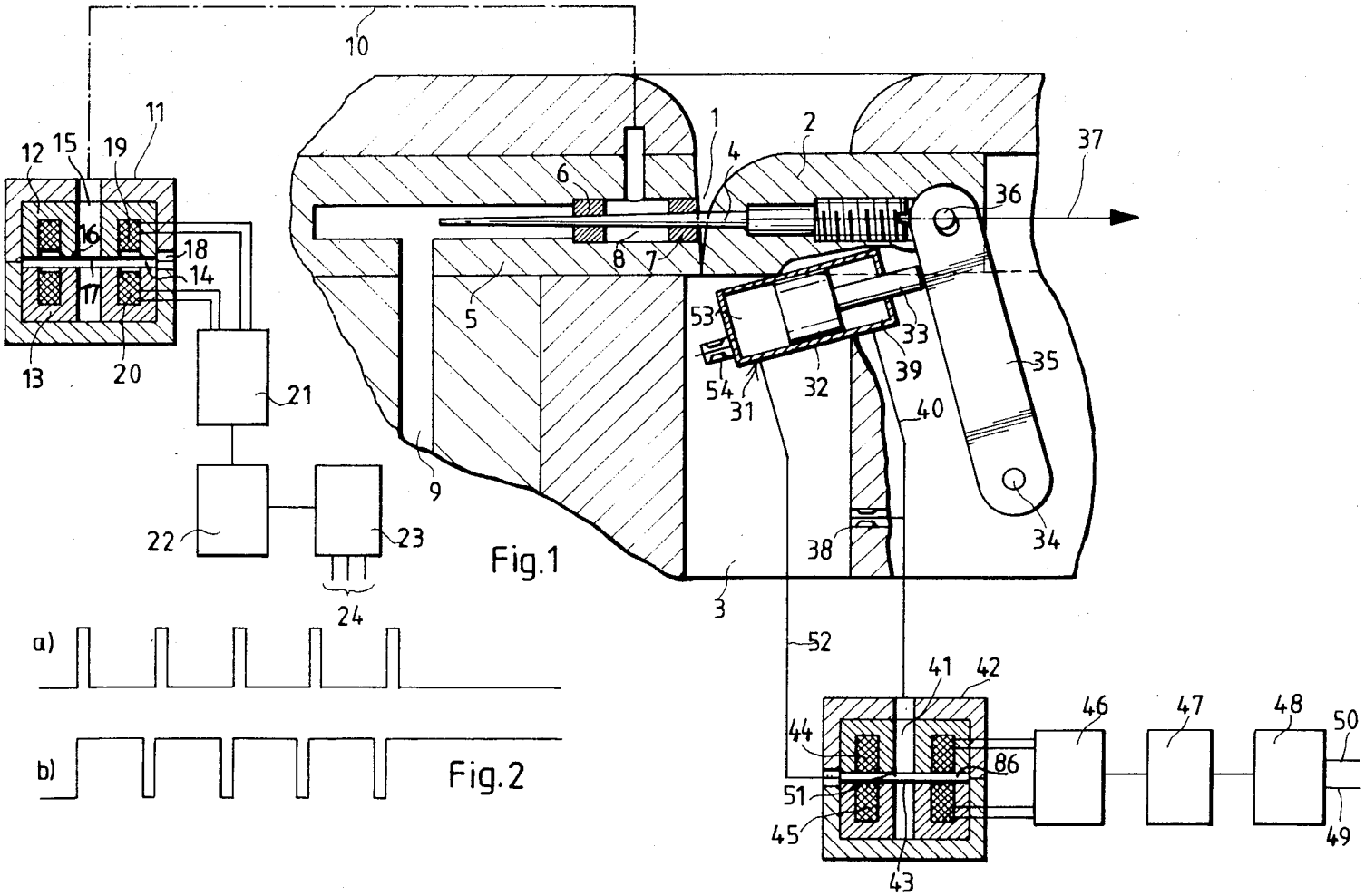
FIG. 2 is a pulse diagram for the control of the flow control valve, whilst

The high-velocity carburetor contains within an atomizer pipe 1 a slide 2, which is operable from the gas pedal in the direction of the arrow 37 against a restoring force and adjusts the cross-section of the atomizer pipe 1. The suction pipe 3 is attached to the atomizer pipe 1. The slide 2 carries a nozzle needle 4, which projects into a nozzle connection 5. The nozzle connection 5 contains coaxially one after the other two nozzles 6, 7; through the nozzle apertures thereof the nozzle needle 4 extends. There is an intermediate chamber 8 between the nozzles 6 and 7. The fuel is fed via a fuel channel 9. The high-velocity carburetor does not need a throttle valve. The high velocity of flow in the region of the nozzle secures excellent atomization and, thus, promotes mixture formation.

The intermediate chamber 8 is connected via a line 10 with a flow control valve 11. The flow control valve 11 contains two pot cores 12, 13 opposing each other which limit a circular valve chamber 14 between them. In the core part of the pot core 12 an outlet channel 15 is arranged, to which the line 10 is connected. The orifice of the outlet channel 15 forms a valve seat 16. Within the valve chamber 15 is a membrane-like valve plate 17 consisting of a ferromagnetic material. This valve plate 17 is light in weight and almost without inertia. Consequently it is easily movable under the influence of a magnetic field and with regard to the frequencies utilized, it always fits fully on the specific valve port. An input channel 18 is connected via a line, not shown, with the air filter, not shown.

Each pot core 12, 13 comprises a coil 19, 20 respectively. The two coils 19, 20 are connected to push-pull outputs of a pulse generator 21 with controllable pulse duty factor of the pulse duration to the pulse space. The pulse duty factor is controlled by a control circuit 22, which is coupled with a performance characteristic field memory 23. The inputs 24 of the performance characteristic field memory 23 carry signals regarding the load condition, speed condition and the temperature condition of the specific combustion engine. The performance characteristic field memory 23 is designed as an address memory. The addresses are scanned by the signals on the inputs 24. An information value stored in a specific address place is given into the control circuit 22 and defines the pulse duty factor of the pulse generator. This pulse duty factor defines the relative opening period of the flow control valve and thus the quantity of the air admixture. Thereby it is possible to weaken the fuel-air mixture. In any case the condition of the mixture can be precisely adjusted.

FIG. 2 shows at "a" an output of the pulse generator 21, the pulse shape having a pulse duty factor close to 0%. The pulse duration is very small, the pulse space is comparatively long. Of course, the pulse duty factor may also have the value 0%. FIG. 2 at "b" shows a pulse duty factor close to 100% on the same output of the pulse generator 21. The pulse duration is very long, the pulse space is very short. The pulse duty factor can be increased up to 100%. Between 0% and 100% each pulse duty factor is continuously adjustable.

Therefore, one can determine for a plurality of speed characteristic lines, which can be addressed as a function of parameters, the mixture ratio of the fuel-air mixture by the addition of air. These characteristic lines, which are stored in the address memory form a performance characteristic field which guarantees an optimum composition of the mixture.

In the case of Otto engines the idling adjustment presents difficulties, because the idling speed easily changes in case of changes of load. In case of a given idling speed it is normally necessary to run with an enriched or fatted fuel-air mixture so that proper idling is guaranteed and the engine does not stop. That means an increased production of noxious substances.

As a further development of the invention an adjustment of the idling speed is provided by means of a pneumatic adjusting element in the form of a cylinder 31. Cylinder 31 is shown on the drawings merely schematically. Its real position, of course, does not intersect the suction pipe. The pneumatical cylinder 31 contains a positioning piston 32 with a piston rod 33 which is connected to a lever 35 pivotable about an axle 34. The lever 35 is coupled via a joint 36 with the slide 2 and the nozzle needle 4, respectively. When sliding the piston rod 33 to the right the nozzle needle 4 is taken along in the direction of the arrow 37 like in the case of an operation of the gas pedal. On the other hand, the piston rod 33 is placed loosely on the lever 35 so that the piston rod 33 is not taken along if the gas pedal is operated in the direction of the arrow 37.

Through a nozzle with a restrictor 38 the adjusting chamber 39 of the cylinder 31 is connected via a line 40 with the interior of the suction pipe 3 so that the vacuum existing in the suction pipe 3 is effective directly in the positioning chamber 39 of the cylinder. On the other side the line 40 is connected to a channel 41 of a flow control valve 42, which is designed like the flow control valve 11. The flow control valve 42 contains a valve plate 43 and two coils 44 and 45, which are connected to push-pull outputs of a pulse generator 46 with adjustable pulse duty factor of pulse duration and pulse space. The pulse duty factor of the pulse generator is controlled by a control circuit 47. A difference circuit 48 compares the nominal signal existing on a line 49 for the idling speed with the actual signal existing on the line 50 of the crankshaft speed. When the valve plate 43 fits on the valve seat 51, then the flow control valve 42 is closed. The output of the flow control valve is connected via a line 52 with the cylinder chamber 53 arranged oppositely to the positioning chamber 39. The positioning chamber 53 is connected via a restrictor 54 with the atmosphere. The restrictor 54 has a smaller flow cross-section than the flow control valve 42 and the suction pipe restrictor 38; in addition, the flow resistance of the flow control valve 42 is negligible as compared with the flow resistances of the restrictors.

As long as the actual value of the idling speed on the line 50 is greater that the nominal value on the line 49, the pulse duty factor is controlled in such a manner that the valve plate 43 of the flow control valve 42 is lifted from the valve seat 51. Consequently, there is a connection to the atmosphere via the opened flow control valve 42. A flow with a pressure drop flows through the restrictor 54. Due to the fact that the faces of the piston 32 possess different sizes, that means that the area in the positioning chamber 39 is smaller, and due to the fact that there is substantially the same pressure in the two cylinder chambers, the positioning piston 32 will move to the left, related to FIG. 1. The piston rod 33 is moved back so that the nozzle needle 4 is not influenced.

If the actual value of the idling speed decreases under the desired nominal value, then the pulse duty factor of the pulse generator 46 is controlled in such a manner that the flow control valve 42 is closed to a corresponding extent as a function of the speed deviation. As a result of this the vacuum in the suction pipe 3 becomes effective within the positioning chamber 39 and the atmospheric pressure becomes effective in the cylinder chamber 53 so that the piston rod 33 is moved out and positions the nozzle needle 4. Thus, the nozzle cross-section and the air cross-section is increased so that to a larger extent air-fuel mixture can be sucked in. The idling speed increases. The value of the pulse duty factor determines the adjustment of the slide and thereby the change of the idling speed.

Figure 3:
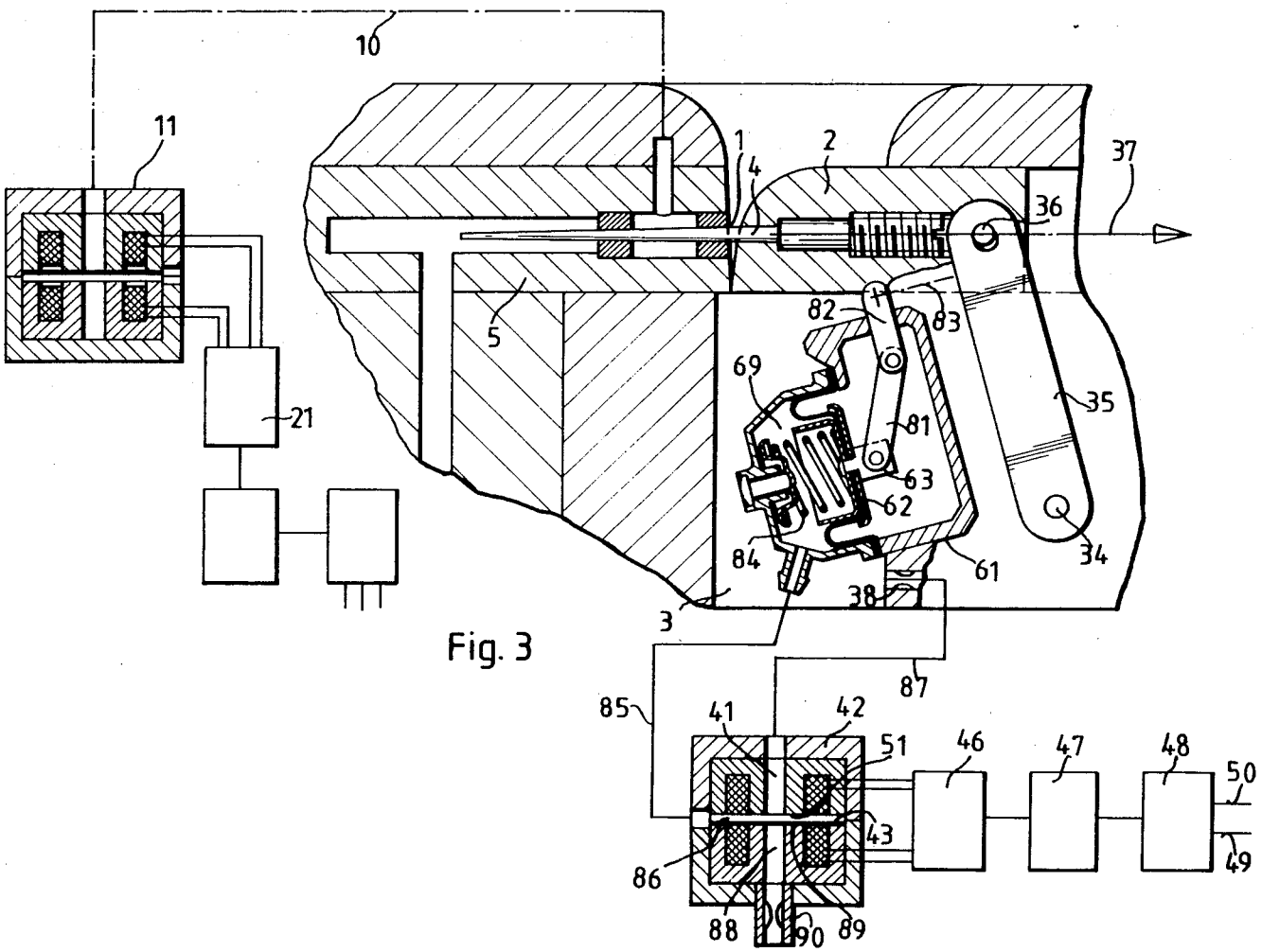
FIG. 3 shows a modified embodiment of the invention.

A modified embodiment of the idling control is shown in FIG. 3. In this case the pneumatic adjusting element is provided as a membrane regulator 61, the positioning piston 62 of which is linked with its piston rod 63 on an angle lever 81. Its leg 82 acts upon the lever 35 by a coupling rod 83. The positioning chamber 69 of the membrane regulator 62 contains a restoring spring 84. The positioning chamber 69 is connected via a line 85 with the valve chamber 86 of the flow control valve 42. The restrictor 38 is connected via a line 87 with the channel 41 of the flow control valve 42 the valve seat 51 of which can be closed by the valve plate 43. A further channel 88 of the flow control valve 42, which also comprises a valve seat 89 that can be closed is connected via a restrictor 90 with the atmosphere.

The adjustment of the membrane regulator is effected in such a manner that in case of idling speed falling below the nominal value the pulse generator 46 delivers a pulse sequence scanned in such a manner that the valve plate 86 rests on the valve seat 89. Owing to this the full vacuum of the suction pipe 3 is effective in the adjusting chamber 69 via the restrictor 38 so that the lever 35 is actuated. Consequently, the nozzle and the slide are opened so that to an increased extent air-fuel mixture is sucked in. As a result of this the actual idling speed increases. As soon as the idling speed reaches its nominal value, the pulse generator 46 is rescanned so that the valve plate 43 is kept in contact on the valve seat 51. Now atmospheric pressure becomes effective within the adjusting chamber 69 so that the restoring spring 84 resets the piston 62. As a result of this the lever 35 also moves back. By the control of the pulse duty factor it is possible to position any intermediate position of the piston 62 and thus to reguide the actual value of the idling speed in each case to the nominal value.

We claim the following:

1. A high velocity carburetor for an Otto engine, comprising:

(a) a suction pipe having a cross-sectional area;

(b) a slide, and means for mounting said slide so as to change the cross-sectional area of said suction pipe;

(c) a nozzle connection having coaxially mounted therein apertured nozzle members in spaced relation so as to define therebetween an intermediate chamber;

(d) a profiled nozzle needle mounted on said slide and extending through the aperture of said nozzles, and means for axially moving said profiled nozzle needle relative to said nozzle members so as to form and variably control an annular gap between said nozzle needle and said nozzle members;

(e) a flow control valve for controlling the supply of air to the carburetor, said flow control valve having an outlet channel communicating with said intermediate chamber and an input channel connecting with atmospheric air, said control valve further having a freely movable, low inertia ferromagnetic membrane-like valve plate functioning as an electromagnetic core, and opposed electromagnetic cores for operating said valve plate in response to signal outputs;

(f) a pulse generator having push-pull outputs connected to said cores, said pulse generator having an adjustable pulse duty factor and generating output signals which define the opening period of the flow control valve and thus the quantity of air supplied; and (g) an address memory for controlling the pulse duty factor of said pulse generator, said address memory being addressed by operating load values, and speed and temperature values of the engine, said memory storing performance characteristic field information values for the pulse duty factor;

whereby the precise amount of air supplied to said intermediate chamber can be adjusted in accordance with said information values and consequently the pulse duty factor.

2. The high velocity carburetor of claim 1, characterized in that the performance characteristic field is arranged in speed characteristic lines according to load and temperature parameters and also contains particular acceleration characteristic lines.

3. The high velocity carburetor of claim 1, further including a membrane regulator for adjusting the idling speed of the engine, said membrane regulator having a positioning chamber and a piston operatively connected through a lever to said slide; and a second flow control valve having a valve chamber communicating with said positioning chamber, opposed valve seats, and a valve plate movable between a first position closed on one of said valve seats and in which said piston and lever are actuated to increase the idling speed, and a second position closed on the other of said valve seats and in which said piston is withdrawn and the idling speed unaffected, and a pulse generator and related control circuit for controlling the position of said valve plate of said second control valve.

4. The high velocity carburetor of claim 1, further including a pneumatic positioning element for adjusting the idling speed of the engine, said pneumatic positioning element comprising a piston connected to a piston rod extending therefrom which serves to position said slide, the piston on the side thereof from which said piston end extends defining the first positioning chamber communicating with said suction pipe, and on the opposite side thereof a second positioning chamber connected to atmosphere;

a second flow control valve having a channel communicating with said first positioning chamber, a freely movable, low inertia second valve plate controlling a flow path to said second positioning chamber;

a second pulse generator having a pulse duty factor, and a control circuit for controlling said pulse duty factor; and a difference circuit for comparing a signal indicative of crankshaft and thus idling speed with a predetermined signal respresenting desired idling speed;

whereby when said second valve plate is moved to a closed position in response to said second pulse generator, said slide and said nozzle needle are moved outwardly due to relatively higher pressure in said second positioning chamber, thereby increasing the idling speed.

5. The high velocity carburetor according to claim 4, characterized in that a further restrictor is positioned in the connection with the atmosphere, the flow cross-section of said further restrictor being smaller than the flow cross-section of the restrictor to the suction pipe.

6. The high velocity carburetor according to claim 4, characterized in that said pneumatic positioning element is a double acting cylinder, said first positioning chamber of which is traversed by the piston rod and is connected immediately with the suction pipe, and the second positioning chamber of which is connected on one side with the atmosphere and on the other side with said second flow control valve.

7. The high velocity carburetor according to claim 4, characterized in that a restrictor is positioned in the connection between the first positioning chamber and the suction pipe.

8. The high velocity carburetor according to claim 7, characterized in that said second flow control valve has a greater flow than said restrictor.

* * * * *